United States Patent [19]

Mori et al.

[11] Patent Number: 4,655,681

[45] Date of Patent: Apr. 7, 1987

[54] SEAL-LESS PUMP

[75] Inventors: Youji Mori, Ichikawa; Kenichi Satou, Noda, both of Japan

[73] Assignee: World Chemical Co., Ltd., Tokyo, Japan

[21] Appl. No.: 744,725

[22] Filed: Jun. 14, 1985

[30] Foreign Application Priority Data

Jul. 26, 1984 [JP] Japan ..... 59-155737

[51] Int. Cl.[4] ..... F03B 13/10; F04D 29/16

[52] U.S. Cl. ..... 415/100; 415/143; 415/170 B; 415/199.4

[58] Field of Search ..... 415/96–100, 415/143, 93, 170 A, 170 B, 172 R, 175, 198.1, 198.2, 199.1, 199.4, 199.5, 199.6

[56] References Cited

U.S. PATENT DOCUMENTS

| | | | |
|---|---|---|---|
| 1,821,772 | 9/1931 | Ruthman | 415/170 A |
| 1,999,163 | 4/1935 | Allen | 415/170 A |
| 2,155,452 | 4/1939 | Stelzer | 415/98 |
| 3,102,680 | 9/1963 | Fogleman et al. | 415/199.4 |
| 3,190,226 | 6/1965 | Judd | 415/213 |
| 4,526,507 | 7/1985 | Bingler | 415/170 R |
| 4,527,947 | 7/1985 | Elliott | 415/98 |

FOREIGN PATENT DOCUMENTS

| | | | |
|---|---|---|---|
| 179275 | 12/1953 | Austria | 415/175 |
| 888207 | 7/1953 | Fed. Rep. of Germany | 415/143 |
| 623994 | 9/1978 | U.S.S.R. | 415/143 |

*Primary Examiner*—Robert E. Garrett
*Assistant Examiner*—Joseph M. Pitko
*Attorney, Agent, or Firm*—Sughrue, Mion, Zinn, Macpeak, and Seas

[57] ABSTRACT

A multi-stage metallic pump or chemical pump with plural impellers arranged in series. The impeller of the 1st-stage is integrally provided with radial flow ribs on the under surface of the impeller and with backside radial ribs on the upper surface of the impeller, which are larger than the front radial flow ribs as regards the diameter of the circle formed by the tips of the respective ribs. A flange is formed as an extension beyond the circumference of the 1st-stage impeller and is integrally provided with a protruding ring on the upper surface of the flange. The protruding ring rotates in a fixed recess formed in a casing, with a certain gap kept. Because of the rotation, the liquid which flows into the clearance between the fixed wall of the casing and the rotating ring creates a turbulent flow there, preventing movement of air there through. As for liquid leaks, since the backside radial ribs are larger in outer diameter, they are higher in peripheral speed and pressure and thus force back the liquid migrating from the radial flow ribs. Thus the liquid is stopped. Therefore, no seal member is required.

6 Claims, 4 Drawing Figures

SEAL-LESS PUMP

BACKGROUND OF THE INVENTION

The present invention relates to seal-less pump. Particularly it relates to a high pressure multi-stage seal-less pumps not requiring seal member, in which liquid leaks and air suction are prevented.

Hitherto, a multi-stage metallic pump or plastic chemical pump which has required high pressure for transferring liquids such as fresh water or a chemical solution has required a mechanical seal or bearing.

However, especially when liquids such as chemical solutions which are liable to be crystallized or gasified are transferred, many problems arise. For example, sliding parts are worn, or air is collected in the bearing portion, to generate heat, or the shaft is partially worn at contact portions due to eccentricity caused by abnormal wear, causing decentering. Furthermore when a chemical pump is designed for high pressure applications, the increase in the number of impeller stages highlights the reliability of the mechanical seal, and for higher pressures, the mechanical seal must be made precise, using a material high in heat resistance, sliding capability and thermal conduction suitable for the chemical solution concerned. Thus, the pump becomes large, and yet the upper limit of pressure is only about 5 $kg/cm^2$. It is also difficult to select an appropriate material for the mechanical seal for the respective kinds of chemical solutions.

Some materials resist chemical solutions but are vulnerable to wear. Some resins are low in thermal conductivity and are therefore liable to be deformed. Thus, generally suitable seal materials are not available. Furthermore, since sliding members are always used, the wear of the seal when transporting very pure water has remained a problem.

OBJECTS OF THE INVENTION

An object of the present invention is to prevent leakage of the liquid in the pump, and the air suction from space section provided above the 1st-stage impeller into the vortex chamber, as far as possible, in a high pressure multi-stage seal-less pump, without using liquid seal device.

Another object of the present invention is to provide a high pressure multi-stage seal-less pump which does not require liquid seal member to seal the liquid in the pump, even at a high discharge pressure. A further object of the present invention is to provide a mechanism which allows idling and does not require a seal selected for the chemical solution concerned.

To attain the said objects, the present invention provides a multi-stage pump with plural impellers arranged in stages in series in a casing and rotatably supported by a shaft, comprising radial flow ribs provided integrally on the under surface of the 1st-stage impeller, and backside radial ribs of larger diameter than the radial flow ribs. The pump is also provided integrally on the upper surface of the impeller with a flange, formed as an extension beyond the circumference of the 1st-stage impeller, and a protruding ring, being integrally provided on the upper surface of the flange, for rotation in a fixed recess provided in the casing, with a constant gap kept, thereby intercepting the air from the space section provided above the 1st-stage impeller, at the gap portion.

With the present invention, when the liquid passes the 1st-stage impeller, an internal pressure is generated, and because of the pressure applied, the liquid migrates to the backside radial ribs and is forced back, to attain sealing. Furthermore, because of the higher pressure than that in the backside portion, air is not sucked in. For this reason, the liquid is forced to pass the 1st-stage impeller positioned above.

The objects and features of the present invention can be understood more clearly with reference to the following detailed description and the attached drawings. It is understood that the detailed description and the attached drawings are provided solely for description and do not restrict the scope of the present invention and do not sacrifice any of the benefits of the present invention, and that various changes and modifications can be made in the invention without departing from the spirit and scope thereof.

BRIEF DESCRIPTION OF THE DRAWING

The drawings show examples of the present invention.

In the drawings, the same portions and the same elements are given the same symbols.

DETAILED DESCRIPTION OF THE INVENTION

Figure 1:
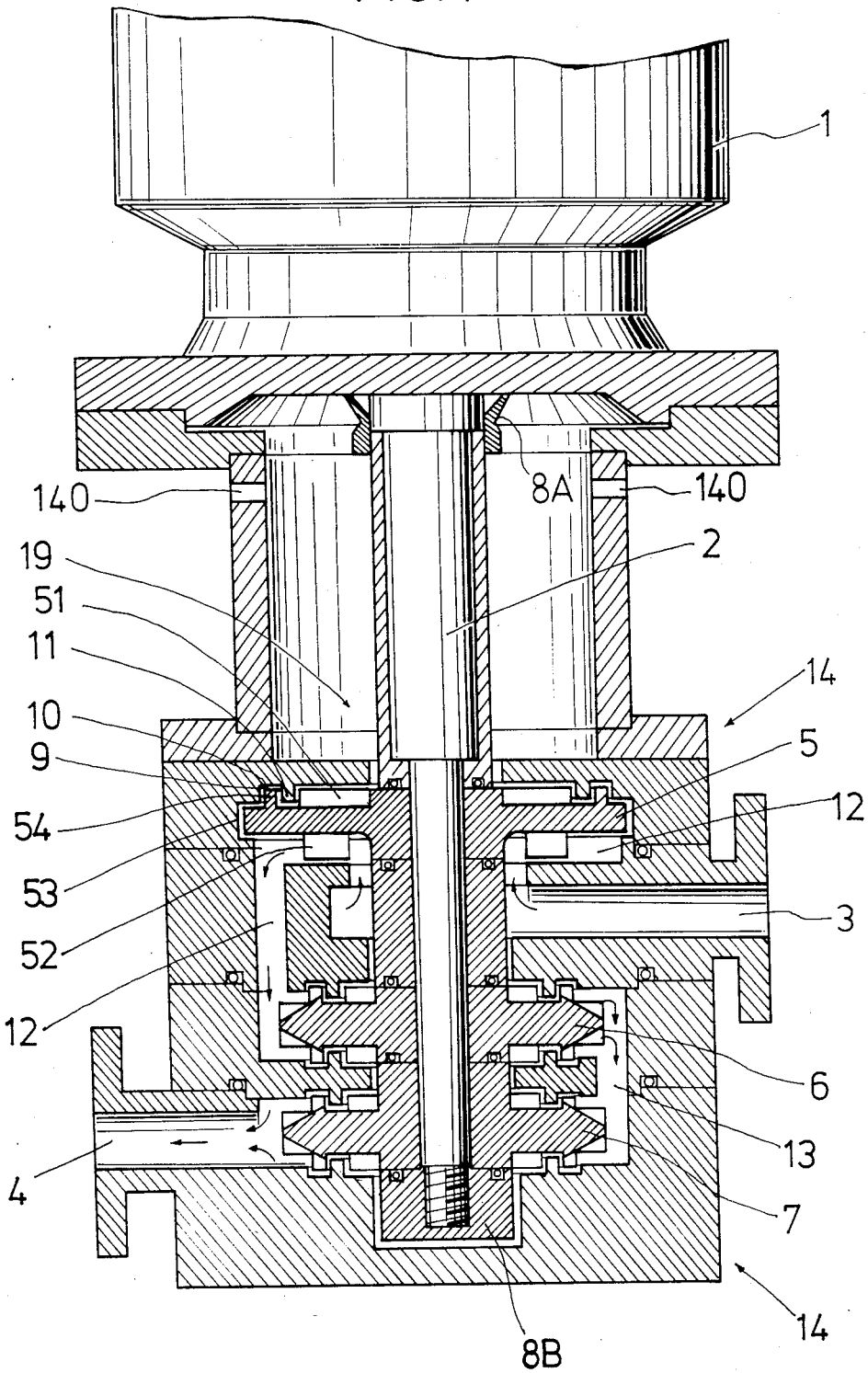
FIG. 1 is a longitudinal sectional view showing an important portion of an example in which the present invention is applied to a high pressure multi-stage cascade pump.

At first, an embodiment in which the present invention is applied to a cascade pump will be described with reference to FIG. 1.

A casing 14 has a suction port 3 and a discharge port 4, and contains a shaft 2 supported rotatably. Around the shaft 2, a boss 88, a 3rd-stage impeller 7, a 2nd-stage impeller 6 and a 1st-stage impeller 5 are fixed in this sequence from the bottom of the casing with clearances therebetween. The shaft 2 is connected to a drive motor 1 at the top, to be driven and rotated. At the bottom end, the said boss 8B is threadedly connected. Above it, the 3rd-stage impeller 7, 2nd-stage impeller 6 and 1st-stage impeller 5 are fitted in this sequence.

On the under surface of the 1st-stage impeller 5, radial flow ribs 52 are formed curving outwardly from the center of the impeller and disposed at constant intervals in the circumferential direction. The radial flow ribs 52 have a preset height.

Figure 3:
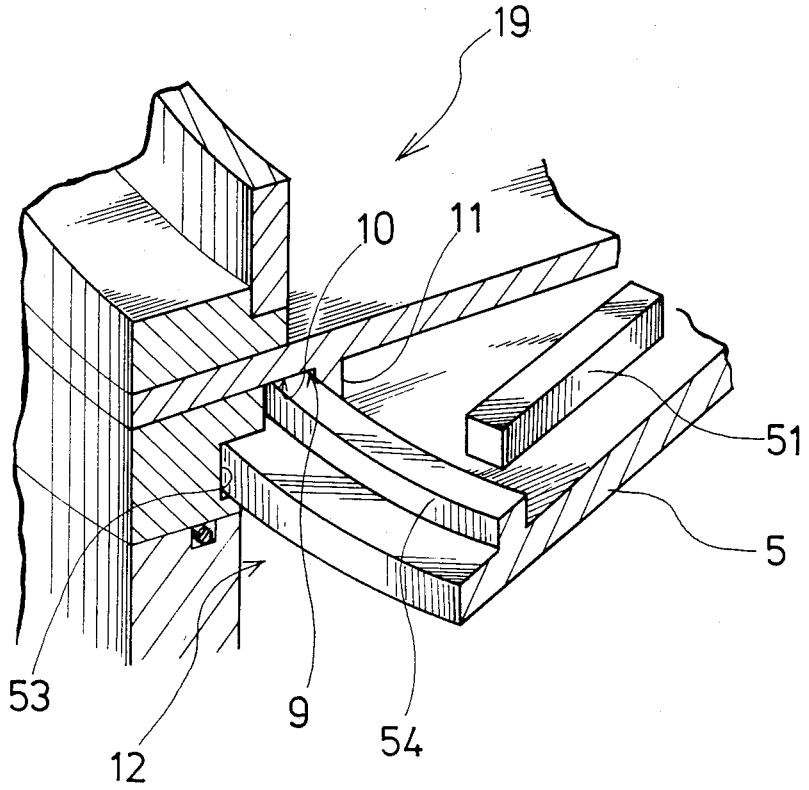
FIG. 3 is an enlarged expanded perspective view showing an important portion of FIGS. 1 and 2, which shows the backside structure of the 1st-stage impeller and the internal structure of the casing opposite to the backside of the 1st-stage impeller.

On the upper surface of the 1st-stage impeller 5, as shown in more detail in FIG. 3, backside radial ribs 51, the outer tips of which define a circule having a diameter larger than a like circle defined by the ribs 52 are integrally radially formed so as to protrude from the impeller 5. The 1st-stage impeller 5 is formed almost like a disc, and on its upper surface near its circumferential edge portion 53, a protruding ring 54 is formed. The ring 54 is inserted in a recess (groove) ring 10 provided on the surface of the casing 14 opposite the 1st-stage impeller 5, without contact and with a certain gap maintained. The ring 54 is driven to rotate within the recess 10 without contact, as the shaft 2 is driven by the motor 1.

In this construction, the liquid draws in from the suction port 3 is driven outwardly due to the centrifugal action caused by the radial flow ribs 52 formed on the 1st-stage impeller 5 and reaches the 2nd-stage impeller 6 through a vortex chamber 12. It is then driven outwardly by the centrifugal action of the 2nd-stage impeller 6 and reaches the 3rd-stage impeller 7 through a vortex chamber 13, to be further driven by its centrifugal action, thus being discharged from the discharge port 4 successively and continuously as a high pressure fluid.

Inside the casing, a space section 19 is formed around the shaft 2 above the 1st-stage impeller 5. In the surrounding wall of the casing 14 in the upper part of the space section 19, air inlets 140 and 140 are formed, to allow air to flow into the space section 19 from the inlets 140 and 140. The space section 19 communicates, at its bottom, with the vortex chamber 12 through the 1st-stage impeller 5.

If the construction as described above is adopted, liquid does not leak from the vortex chamber 12 into the space section 19, and the air in the space section 19 does enter the vortex chamber 12, even in a high pressure multi-stage pump.

The principles of operation will be described below.

(1) The diameter of the circle formed by the tips of the backside radial ribs 51 of the 1st-stage impeller 5 is larger than that of the radial flow ribs 52, and the pressure generated by the backside radial ribs 51 (centrifugal action) is larger than the pressure generated by the radial flow ribs 51 (liquid pressure). Therefore, a pressure difference is caused between the vortex chamber 12 and the space section 19 to prevent the liquid drawn into the vortex chamber 12 from flowing and leaking into the space section 19. That is, since the diameter of the circle formed by the tips of the backside radial ribs on the upper surface of the 1st-stage impeller is larger that of the radial flow ribs, the liquid moving from the tips of the radial flow ribs is forced back due to the higher pressure created by the backside radial ribs, to attain a balanced liquid seal.

(2) The liquid with pressure applied by the rotating action of the radial flow ribs 52 flows through the vortex chamber 12 to the 2nd-stage impeller 6, but because some of the liquid will flow upwardly over the upper surface of the disc (flange) 53, the liquid also flows into the gap portion 9 formed between the protruding ring 54 and the recessed groove 10. However the latter liquid is forced back by the centrifugal action caused by the rotation of the backside ribs 51 of high peripheral speed, and thus balance is kept to form a liquid seal. In addition to this liquid seal action, the liquid leak preventing action described in (1) is synergistically applied, to assure a more reliable liquid seal effect.

(3) Even if the air in the space section 19 tends to be drawn into the vortex chamber 12 by the rotation of the backside radial ribs 51, centrifugal acceleration is not applied since the air is light. The air first collides with the fixed protruding ring 11, and the remaining air which passes by the fixed ring 11 collides with the ring 54 of the 1st-stage impeller 5. Thus the air encounters resistance at these respective portions. Furthermore, little centrifugal acceleration is applied to the liquid containing the air from the space section 19, and as described in (2), the liquid in the vortex chamber 12 is always driven toward the flange 53 by the centrifugal action caused by the radial flow ribs 52. Thus the balance of pressures is maintained. Therefore, the flow of the air from the space section 19 into the vortex chamber 12 is prevented by the labyrinth packing action of said protruding rings 11 and 54 and the recessed groove 10 and by said pressure balance.

Thus, both a liquid seal and the prevention of air inflow between the vortex chamber 12 and the space section 19 are attained.

Figure 2:
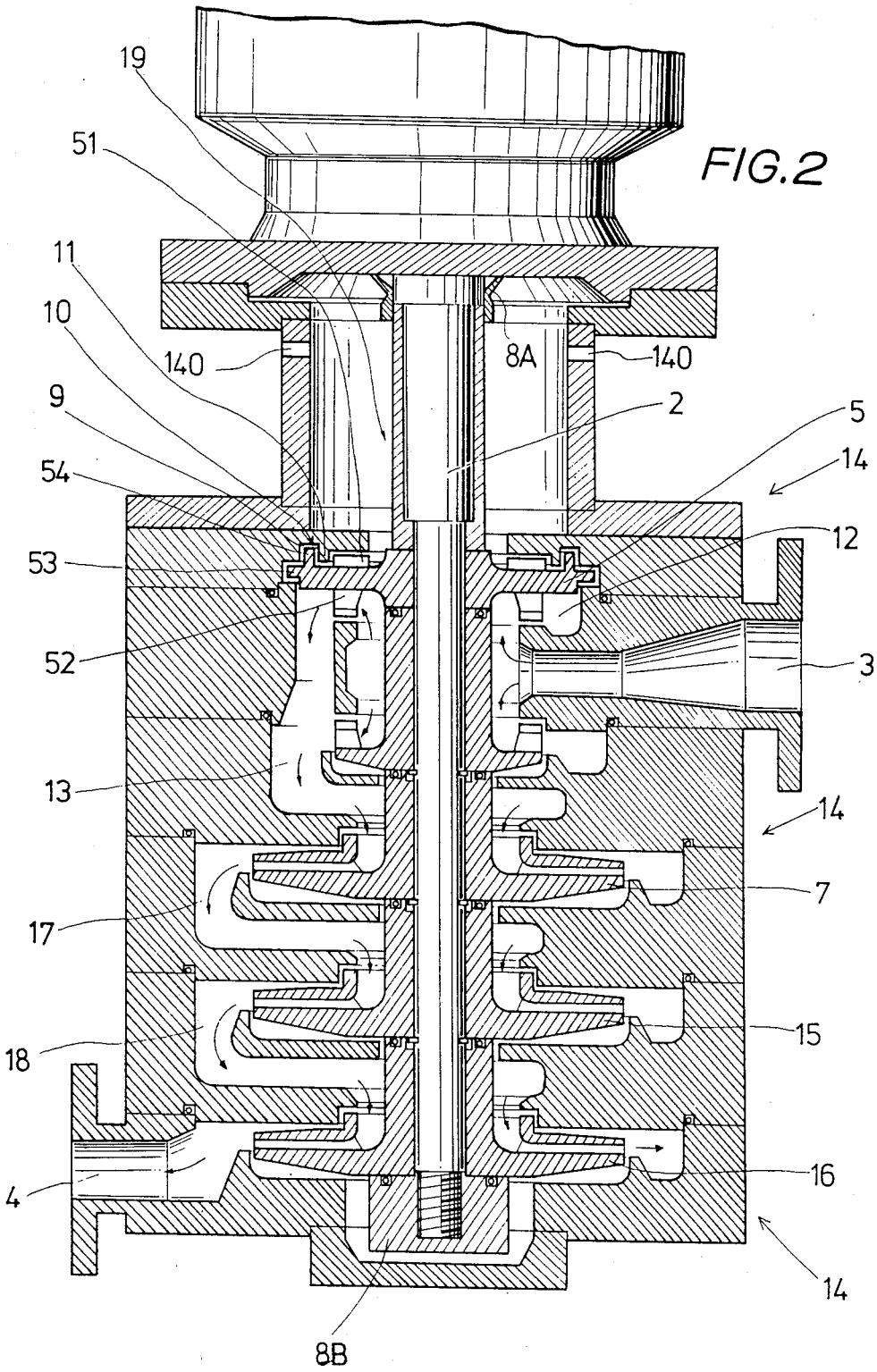
FIG. 2 is a logitudinal sectional view showing an important portion of another example where the present invention is applied to a high pressure multi-stage volute pump.

FIG. 2 shows another embodiment is which the present invention is applied to a multi-stage volute pump, where the same portions as in FIG. 1 are given the same symbols.

In FIG. 2, a casing 14 is provided with a suction port 3 and a discharge port 4 for a liquid. The discharge port 4 is provided below the suction port 3 at the bottom of the casing 14. At the center of the casing 14, a shaft 2 which is rotatably driven by a motor 1 is supported vertically. At the top and bottom of the shaft 2, fastening bosses 8A and 8B are connected, and between them, a 1st-stage impeller 5, a 2nd-stage impeller 6, a 3rd-stage impeller 7, a fourth stage impeller 15, and a 5th-stage impeller 16 are fitted in this sequence from above.

Figure 4:
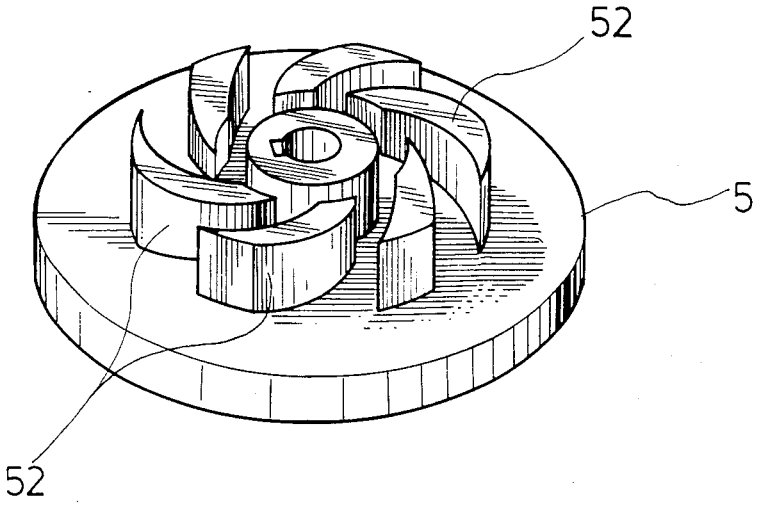
FIG. 4 is an expanded perspective view showing the front side structure of the 1st-stage impeller on the liquid suction port side.

The structure of the 1st-stage impeller 5 is almost the same as that shown in FIGS. 3 and 4. That is, a protruding ring 54 of the 1st-stage impeller is disposed in a recessed groove 9 of the casing 14 without contact and with a constant gap being maintained. The ring 54 rotates in the recessed groove 9 according to the rotation of the shaft 2 driven by the motor 1.

On the upper surface of the 2nd-stage impeller 6, radial flow ribs 61 are formed to rise, curving from the center of the impeller toward the outside, at intervals in the circumferential direction, to face the radial flow ribs 52 of the 1st-stage impeller 5 through the suction port 3. In this construction, the radial flow ribs 52 of the 1st-stage impeller 5 and the radial flow ribs 61 of the 2nd-stage impeller 6 face each other, and an pump head increases with the increase in the number of stages. However, even if the number of stages increases to 2nd and 3rd stages and even if the discharge port of the final impeller is closed, the discharge pressure of the impeller returns only to the suction port, and even at the final multi-stage high pressure, the liquid does not flow back to the 1st-stage impeller.

The liquid drawn in from the suction port 3 is driven radially outwardly by the centrifugal action caused by the radial flow ribs 52 provided on the 1st-stage impeller 5 and by the centrifugal action caused by the radial flow ribs 61 provided on the 2nd-stage impeller 6, and reaches the 3rd-stage impeller 7 through vortex chambers 12 and 13. It is then driven by the centrifugal action of the 3rd stage impeller 7 into a vortex chamber 17 and reaches the 4th-stage impeller 15. The liquid is further driven by the centrifugal action of the 4th-stage impeller 15, to the 5th-stage impeller 16 through a vortex chamber 18. Thus the number of impellers can be increased infinitely. At the high pressure obtained by the centrifugal action corresponding to the number of stages of impellers, the liquid is continuously discharged from the discharge port 4.

In the structures of the respective embodiments mentioned above, according to the increase in the number of stages after the 2nd-stage impeller, added to enhance the pressure, the distance from the space section 19 becomes long. Therefore, no extra load is applied at all from the space section 19, and no mechanical seal is required between the air side and the liquid intake side, even when the pump is used with an increased number of stages to raise the output pressure.

And in the construction discribed above, even if the discharge port of the final stage is closed, the maximum discharge pressure does not return to the 1st-stage impeller, and the return can be prevented by the negative pressure at the intake port of each impeller. Therefore, it is only required to seal against the discharge pressure of the 1st-stage impeller.

As described above, according to the present invention, even in a high pressure multi-stage pump, liquid sealing and air leak prevention between the air side and the liquid intake side can be positively attained without using special seal member. Furthermore, the present invention can be applied without difficulty to either a low head high pressure cascade pump or to a high head high pressure volute pump.

What we claim:

1. A high pressure multi-stage seal-less pump, in which plural impellers are arranged in serial stages within a casing and are supported and driven by a shaft rotatably supported in the casing, comprising;

radial flow ribs integrally provided on an under surface of a first-stage impeller of said plural impellers, said first stage impeller being positioned below an air space of said pump, backside radial ribs provided integrally on an upper surface of said first-stage impeller, said backside ribs defining a circle of larger diameter than a circle defined by said radial flow ribs, a flange formed as an extension of the first-stage impeller, and a protruding ring provided on an upper surface of said flange, a recessed groove provided in said casing at a location opposite said protruding ring, said ring being received with said groove with a constant gap therebetween, said groove intercepting air drawn from said space section and pumped by the rotation of said radial ribs at said gap, said air at said gap and a fluid pumped by said radial flow ribs being maintained in pressure balance.

2. A high pressure multi-stage seal-less pump according to claim 1, wherein said radial flow ribs are formed form curves extending from a center of the said 1st-stage impeller toward a periphery thereof.

3. A high pressure multi-stage seal-less pump according to claim 1, wherein the said backside radial ribs are formed radially from a center of said 1st-stage impeller toward a periphery thereof.

4. A high pressure multi-stage seal-less pump according to claim 1, wherein said pump comprises a cascade pump or a centrifugal volute pump, said impellers being arranged in series in stages.

5. A high pressure multi-stage seal-less pump according to claim 1, wherein said pump comprises a volute pump, said impellers being arranged in series in stages.

6. A high pressure multi-stage seal-less pump according to claim 1, wherein a second-stage impeller of said plural impellers includes radial flow ribs corresponding to said radial flow ribs formed on said 1st-stage impeller, said second-stage impeller radial flow ribs being formed on the upper surface of said second stage impeller and facing said 1st-stage impeller.

* * * * *